US005399125A

United States Patent [19]

Dozier

[11] Patent Number: 5,399,125

[45] Date of Patent: Mar. 21, 1995

[54] BELT GRINDER

[76] Inventor: Robert L. Dozier, P.O. Box 1941, Springdale, Ak. 72765

[21] Appl. No.: 75,650

[22] Filed: Jun. 11, 1993

[51] Int. Cl.[6] ..... F16H 7/00; B24B 21/00

[52] U.S. Cl. ..... 474/117; 451/303

[58] Field of Search ..... 474/111, 113–117, 474/133–138; 51/141, 148, 135 BT

[56] References Cited

U.S. PATENT DOCUMENTS

| | | | |
|---|---|---|---|
| 2,431,795 | 12/1947 | Elmes | 51/141 |
| 2,706,367 | 4/1955 | MacCarthy | 51/148 |
| 2,763,103 | 9/1956 | Bader | 51/141 |
| 3,524,284 | 8/1970 | Means | 51/141 |
| 4,145,846 | 3/1979 | Howland et al. | 51/141 X |
| 4,669,224 | 6/1987 | Armstrong et al. | 51/148 X |

*Primary Examiner*—Michael Powell Buiz

*Attorney, Agent, or Firm*—Boyd D. Cox

[57] ABSTRACT

A belt grinder includes a base plate mounting a drive motor, belt drive wheel, and belt tensioning idler wheel. A tension arm movably mounted on the base plate is biased to an extended position under a predetermined adjustable bias force to regulate belt tension. Air cylinder and weighted pivot arm embodiments for biasing the tension arm are disclosed. The idler wheel is pivotally mounted on the tension arm for adjusting position of the belt along the axis of the idler wheel. A plurality of grooves in the base plate allow precise securement of various attachments in repeatable alignments. A platen assembly attachment includes a tool rest and belt platen disposed between belt supporting rollers which may be quickly removed from the base plate and reattached in precise alignment without disturbing the adjustment of the tool rest and platen.

20 Claims, 6 Drawing Sheets

BELT GRINDER

BACKGROUND OF THE INVENTION

1. Field of the Invention

The present invention relates to machine tools, and more particularly pertains to belt grinders of the type including an endless loop belt supported and driven by one or more rollers and adapted for performing sanding, grinding, and polishing operations on both metal and nonmetal work pieces.

2. Description of the Prior Art

A wide variety of such belt grinders have been proposed in the prior art. However, such prior art belt grinder devices typically require a great deal of time to set up and to readjust when changing belts and reconfiguring for performing various different operations. Additionally, it is very difficult and time consuming to restore prior art belt grinders to a previously adjusted configuration. Accordingly, prior art belt grinders are not readily adapted for the convenient and repeated performance of a plurality of different work operations and the associated repeatable reconfiguration to different set up adjusted positions.

SUMMARY OF THE INVENTION

Accordingly, it is an object of the present invention to provide a new and improved belt grinder which allows various attachments to be removed and reattached in precise repeatable alignment without disturbing the adjustment of components of the attachments.

It is a further object of the present invention to provide a new and improved belt grinder which is of a durable and reliable construction.

An even further object of the present invention is to provide a new and improved belt grinder which uses an air cylinder to allow precise adjustment of belt tension over a wide range.

Still another object of the present invention is to provide a new and improved belt grinder having a pivotally adjustable idler wheel to provide for precise adjustment of belt position.

Yet another object of the present invention is to provide a new and improved belt grinder having a belt tensioning idler wheel biased to an extended position under a predetermined adjustable bias force to regulate belt tension.

Even still another object of the present invention is to provide a new and improved belt grinder having a platen assembly including an independently adjustable tool rest and belt platen which can be repeatedly removed and reattached without loss of adjustment.

In order to achieve these and other objects of the invention, the present invention provides an improved belt grinder which includes a base plate mounting a drive motor, belt drive wheel, and belt tensioning idler wheel. A tension arm movably mounted on the base plate is biased to an extended position under a predetermined adjustable bias force to regulate belt tension. Air cylinder and weighted pivot arm embodiments for biasing the tension arm are disclosed. The idler wheel is pivotally mounted on the tension arm for adjusting position of the belt along the axis of the idler wheel. A plurality of grooves in the base plate allow precise securement of various attachments in repeatable alignments. A platen assembly attachment includes a tool rest and belt platen disposed between belt supporting rollers which may be quickly removed from the base plate and reattached in precise alignment without disturbing the adjustment of the tool rest and platen.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described preferred embodiments of the invention.

DETAILED DESCRIPTION OF THE PREFERRED EMBODIMENT(S)

Figure 1:
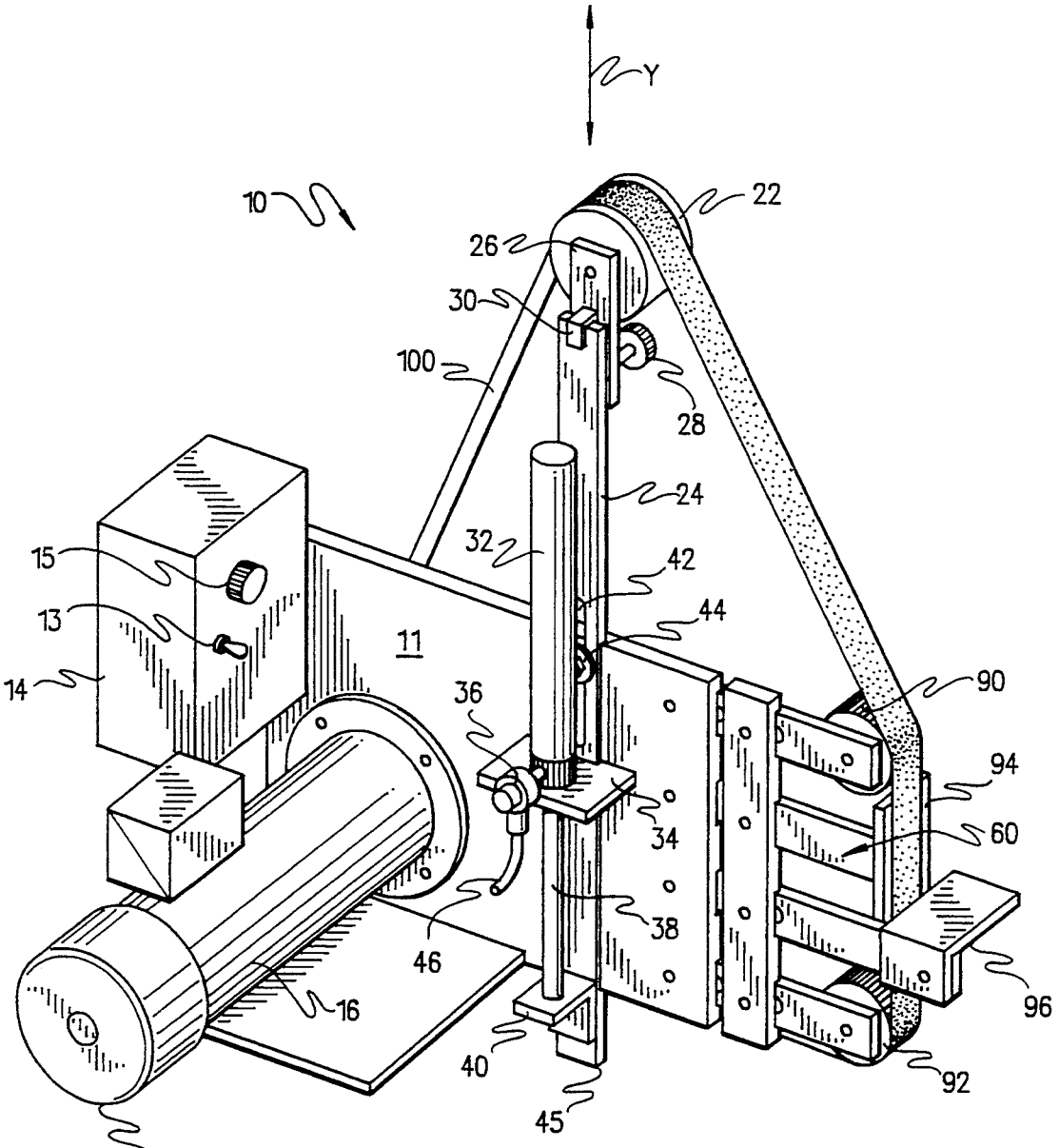
FIG. 1 is a rear perspective view of the belt grinder according to a first embodiment of the invention.
Figure 2:
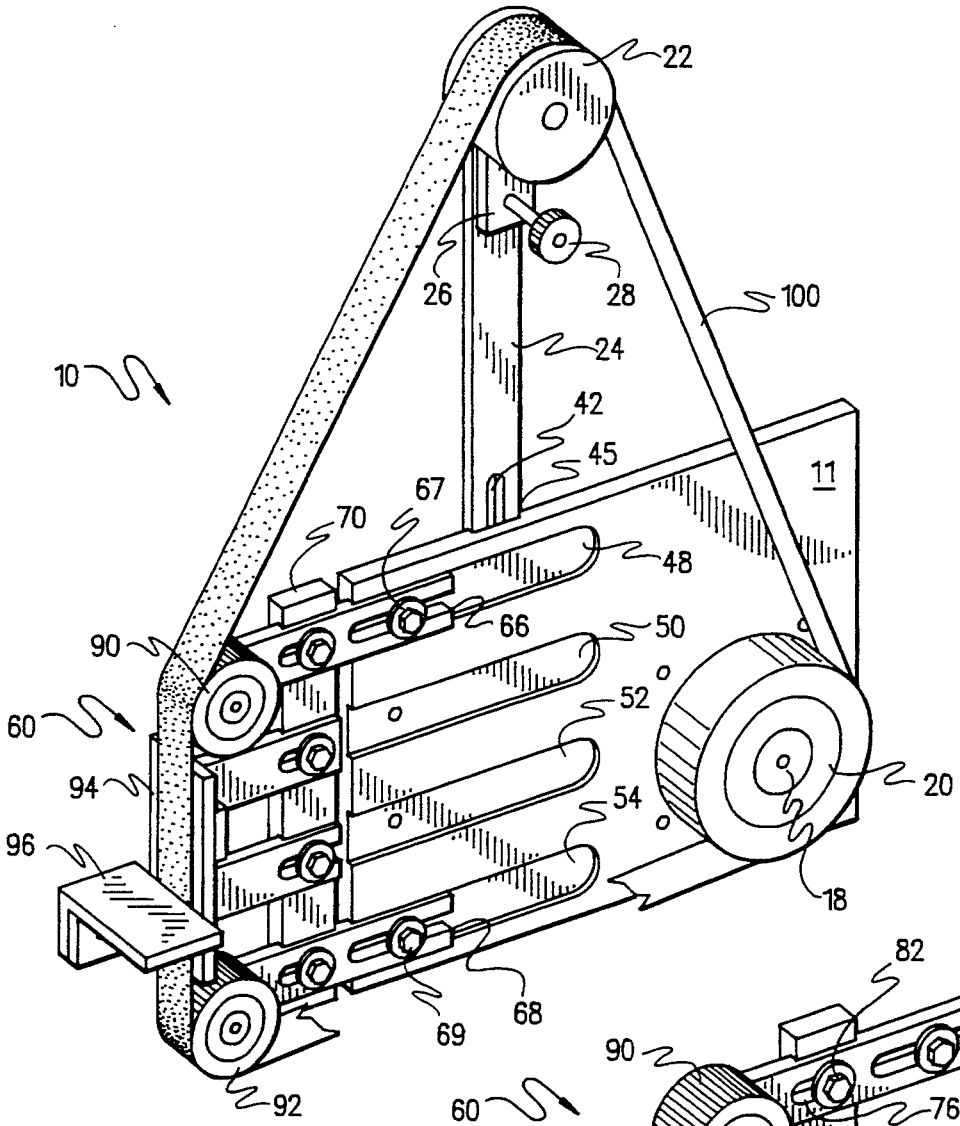
FIG. 2 is a front perspective view thereof.

Referring now to the drawings, wherein like reference numerals designate corresponding structure throughout the views, and referring in particular to FIGS. 1 and 2, an improved belt grinder 10 according to a first preferred embodiment of the invention includes a base plate 11 adapted for mounting in a vertical orientation by suitable supports (not shown). A variable speed D.C. motor, for example having a rated five horsepower output, is controlled by a conventional power supply 14 including on/off switch 13 and speed control knob 15 for the purpose of rotationally driving a spindle assembly 16 including an arbor 18 attached to a belt drive wheel 20.

Figure 6:
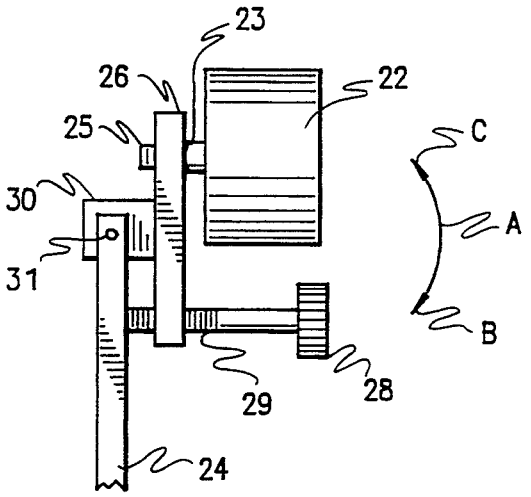
FIG. 6 is a side elevational detail view illustrating the belt tensioning idler wheel pivotal belt position adjustment mechanism thereof.

In order to adjustably tension a sanding, grinding, or polishing belt 100, a belt tensioning idler wheel 22 is mounted for rotation on an upper end of tensioning arm 24. As shown in FIG. 6, an axle assembly 23 of idler wheel 22 includes a threaded stub 25 extending transversely into engagement with a pivot bar 26 pivotally secured to arm 24 for limited rotational adjustment about the axis of a pivot pin 31 extending perpendicular to the axis of idler wheel 22. A fixed hinge lug 30 welded or otherwise transversely secured to a back face of the bar 26 is received in a notch formed in a top edge of the arm 24. A threaded adjustment screw 29 extends through a threaded hole in a bottom end portion of the bar 26 and terminates at an outer end in a knob 28 adapted to facilitate manual manipulation. An inner end face of the screw 29 abuts arm 24 such that rotation of knob 28 in a clockwise direction as viewed in FIG. 2 causes the bottom end of bar 26 to traverse outwardly along screw 29, in a direction toward knob 28, thus effecting pivotal adjustment of the position of the idler wheel 22 as indicated by arc segment A. When knob 28 is rotated in a counter-clockwise direction as viewed in FIG. 2, the bar 26 moves closer to the end face of the screw 29 which abuts arm 24. The torque moment arm of the idler wheel 22 and belt tension thereon about pivot pin 31 maintains abutment of the end face of the screw 29 with the arm 24. Thus, screw 28 allows manual adjustment of the angle of rotational axis of the idler wheel 22 which in turn regulates the position of the belt 100 along the axis of the idler wheel 22 and also, as a result, along the axes of the other belt supporting wheels and rollers. For example, with reference to FIG. 6, pivotal adjustment in the direction of arrow B will cause the belt 100 to move toward the right hand edge of idler wheel 22 and pivotal adjustment in the opposite direction indicated by arrow C will cause the belt 100 to move toward the left hand edge of idler wheel 22. It should be noted that this pivotal belt positioning adjustment may be performed while the belt is in motion.

The tension arm 24 is mounted for reciprocal vertical movement in the direction indicated by arrow Y in FIGS. 1 and 2. To this end, arm 24 is received for reciprocal sliding movement in a vertically extending guide groove 45 machined in a back face of base plate 11. A guide bolt 44 secured to base plate 11 centrally within groove 45 extends through a slot 42 in arm 24 for the purposes of defining upper and lower limits of movement of arm. 24 and for maintaining arm 24 in engagement with groove 45. A transversely extending lug 34 welded or otherwise secured to base plate 11 includes an inner edge notched to allow free passage of the arm 24. The lug 34 supports a fixed single acting air cylinder 32 including a telescopically mounted rod 38 adapted for selective retraction, in a vertically upward direction, upon the controlled application of air pressure from a conventional compressed air source via line 46 to cylinder 32. A terminal end of the rod 38 is fixed to an angle clip 40 secured transversely to a bottom end portion of the arm 24. Upon release of air pressure, the weight of idler wheel 22 and arm 24 causes the rod 38 to move to an extended direction in a vertically downward direction. A regulator 36 controls air pressure to the cylinder 32, thus allowing the upward bias force on the arm 24 and hence the tension on belt 100 to be precisely adjusted within a wide range. The air cylinder 32 also preferably includes a conventional needle valve for regulating the volumetric rate of air flow for the purpose of controlling the speed of movement of the arm 24.

Figure 3:
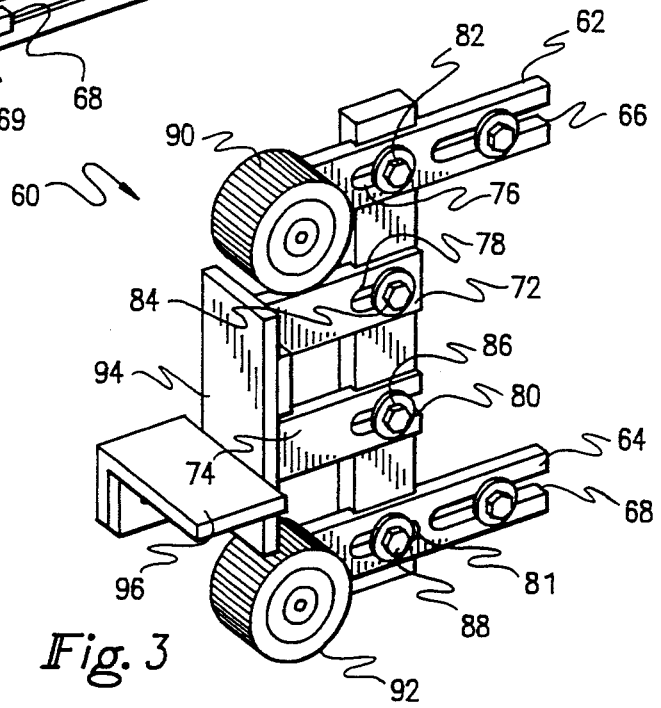
FIG. 3 is a perspective view of a platen assembly attachment thereof.

As shown in FIG. 2, a front face of the base plate 11 includes a plurality of laterally extending grooves 48, 50, 52, and 54 extending in evenly spaced parallel relation. A platen assembly 60, best shown in FIG. 3, includes roller mounting arms 62 and 64 transversely secured in adjusted positions adjacent opposite end portions of a frame member 70. A belt platen 94 is perpendicularly fixed to a platen support arm 72, also secured to frame member 70. Finally, a tool rest support arm 74 secures a tool rest 96 in adjusted position to frame member 70. Frame member 70 includes four laterally extending spaced parallel grooves receiving respective support arms 62, 72, 74, and 64 in vertically spaced relation. Arms 62, 72, 74, and 64 include respective axially extending slots 76, 78, 80, and 88 receiving respective bolts 82, 84, 86, and 88 engaging cooperating threaded apertures in frame member 70 for the purpose of clamping the support arms 62, 72, 74, and 64 in independently adjusted positions. As shown in FIGS. 1 and 3, roller support arms 62 and 64 of platen assembly 60 include axial open ended slots 66 and 68 adapted for cooperation with bolts 67 and 69 for adjustably securing the platen assembly 60 to the base plate 11. Accordingly, as can now be readily appreciated, the platen assembly 60 may be repeatedly removed and reattached to the base plate 11 without disturbing the adjusted positions of the rollers 90, 92, tool rest 96, and belt platen 94.

Figure 4:
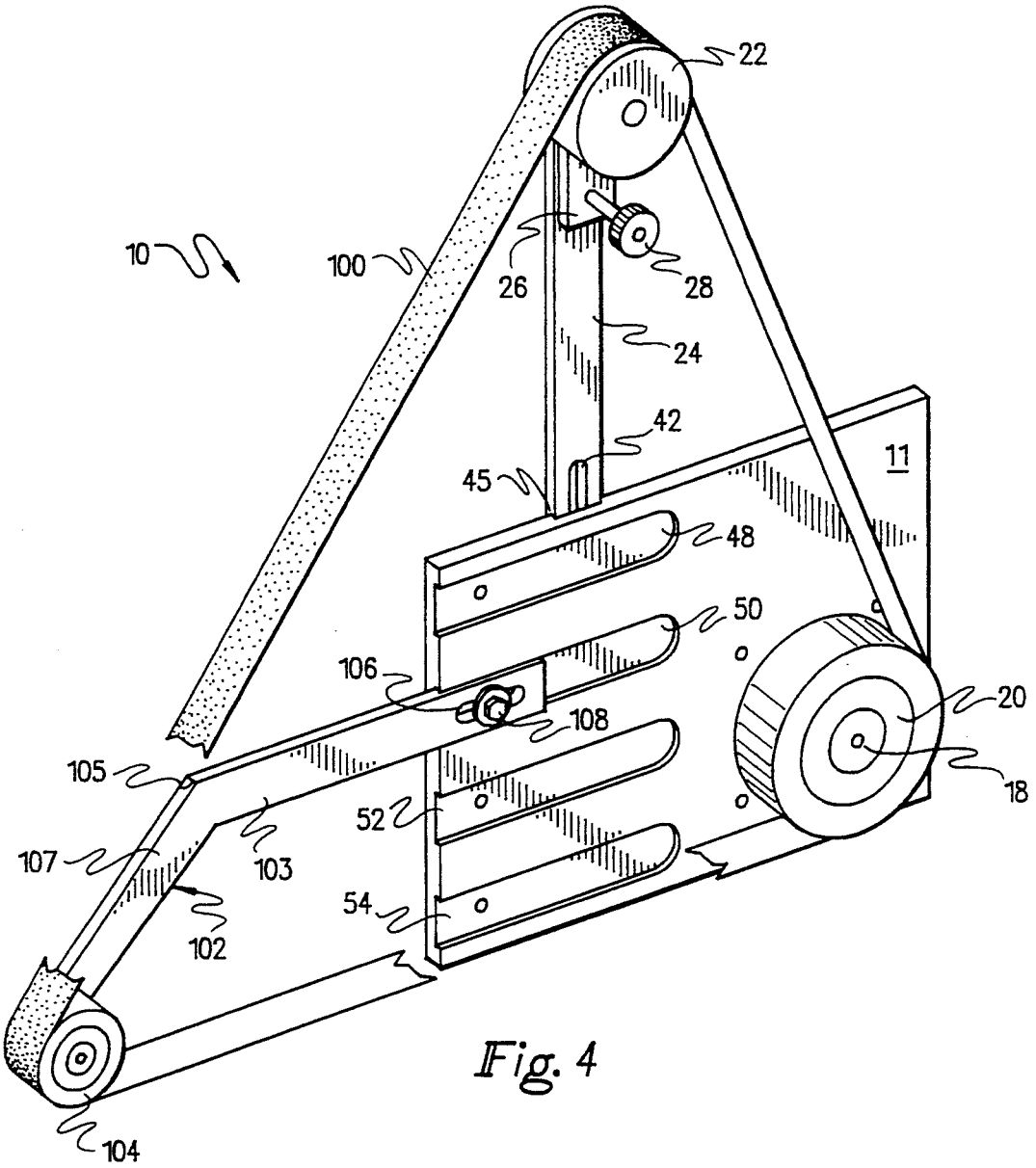
FIG. 4 is a front perspective view thereof, including a slack belting arm attachment.

Other attachments are also optionally useable with the belt grinder 10 of the invention, in place of platen assembly 60. For example, FIG. 4 illustrates a slack belting arm attachment 102 including straight arm portions 103 and 105 intersecting at an obliquely angled corner portion 105. A belt supporting roller 104 is journalled for free rotation at a distal end of arm attachment 102 . A free end portion of straight arm portion 103 is dimensioned for receipt in a selected one of the grooves 48, 50, 52, and 54 in base plate 11, for example in groove 50. A bolt 108 in engagement with slot 106 in arm portion 103 secures the slack belting arm attachment 102 in position. The slack belting arm attachment 102 is intended principally for use in performing operations such as hand shaping and hand finishing materials.

Figure 5:
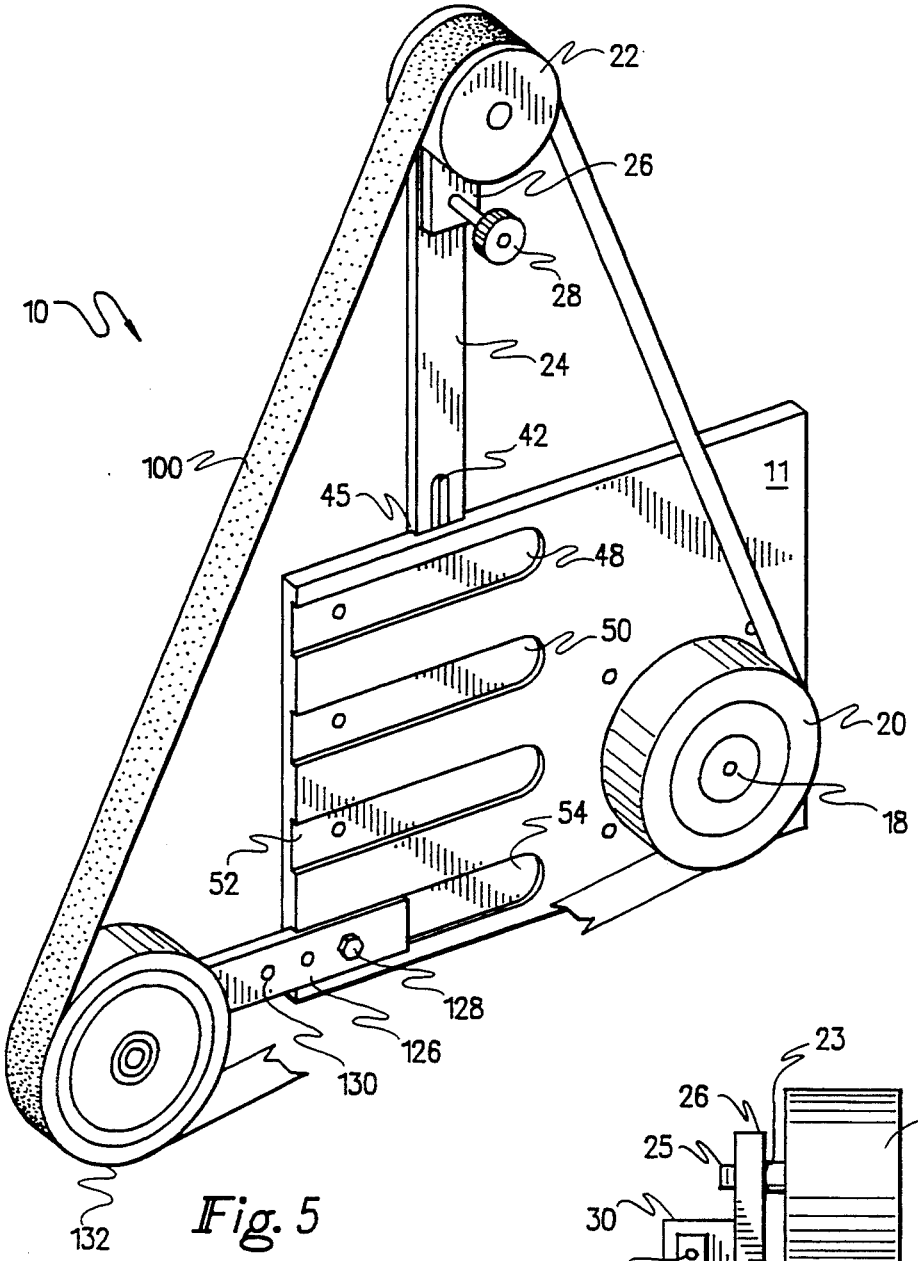
FIG. 5 is a front perspective view thereof, including a grinding wheel attachment.

Another example attachment for the belt grinder 10 is illustrated in FIG. 5, in which a grinding wheel support bar 126 includes a plurality of spaced apertures 130 each dimensioned to receive a bolt 128 for the purpose of securing the bar 126 in one of a plurality of discrete adjusted positions in one of the base plate grooves 48, 50, 52, and 54. A grinding wheel 132 is journalled for free rotation on an end portion of bar 126 and includes a relatively rough textured or toothed surface such that the belt 100 assumes a corresponding textured contour for the purpose of performing grinding operations involving relatively high material removal rates, such as dressing the flashing from forgings and sprue from castings and grinding away excess material on selected items.

Figure 7:
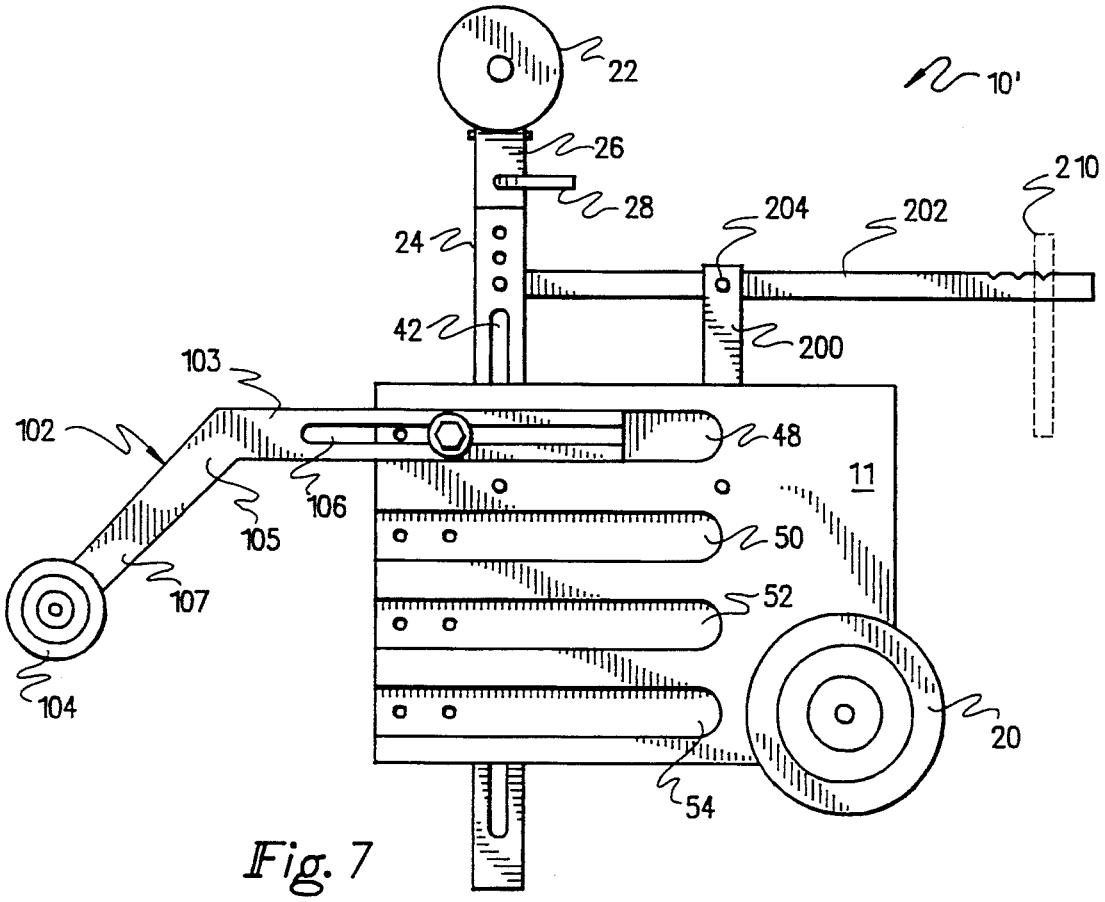
FIG. 7 is a front perspective view illustrating a belt grinder according to a second embodiment of the invention.
Figure 8:
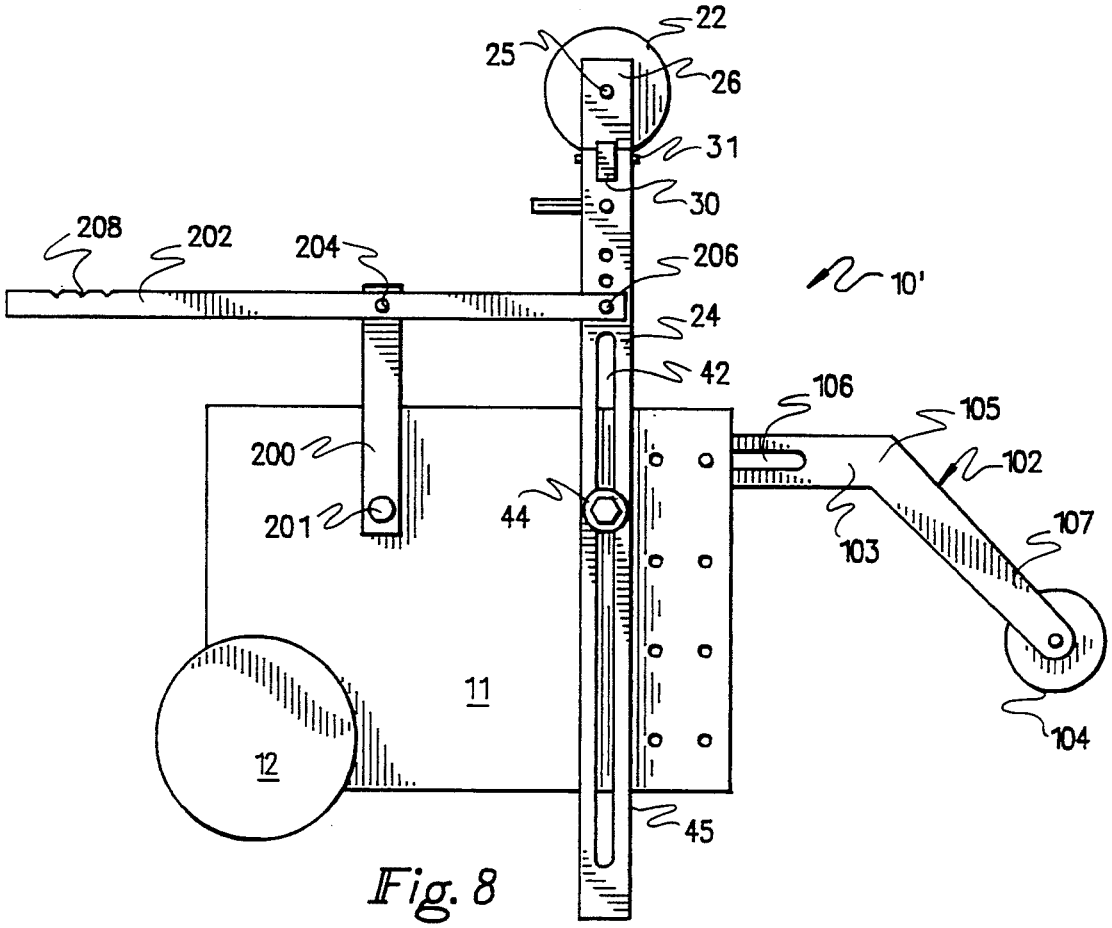
FIG. 8 is rear perspective view thereof.

A second embodiment of the invention 10′, illustrated in FIGS. 7 and 8, is similar in most respects to the first embodiment 10 illustrated and described above. Similar features of the embodiment 10′ have been accordingly designated by identical reference numerals and will not be further described. The belt grinder 10′ differs from the belt grinder 10 principally in the mechanism for applying an upward biasing force to arm 24 to tension belt 100. Rather than a pneumatic bias force, a pivotal linkage and weight system provides a weight bias tensioning force which is adjustable in discrete increments by adding or subtracting weights to the pivotal linkage. This pivotal linkage includes a first strut 200 pivotally connected by a pin, screw, bolt, rivet, or the like at 201 on a back surface of the base plate 11. An elongated pivot arm 202 is similarly pivotally mounted at 204 to an upper end of strut 200, and also at 206 to an upper end of tensioning arm 24. As in the first embodiment 10, a vertical guide groove 45 in base place 11 constrains arm 24 to reciprocal vertical movement. A free end portion of pivot arm 202 includes a plurality of V notches 208 for the reception of one or more apertured or slotted weights 210. Accordingly, it can be readily appreciated that the tension on the belt may be readily adjusted in discrete repeatable increments by adding or subtracting weights 210 from the end of pivot arm 208.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A belt grinder, comprising:

a base plate;

a plurality of horizontally extending parallel grooves in said base plate including fasteners for securing one of a plurality of different attachments to said base plate in repeatable positions;

a drive motor operably connected for driving a belt drive wheel supported on said base plate;

a tension arm mounted by a vertically extending linear guide for reciprocal linear movement on said base plate;

an idler wheel mounted for rotation on said tension arm;

an endless loop belt mounted for rotation between said drive wheel and said idler wheel; and an air cylinder for exerting a predetermined adjustable bias force on said tension arm to regulate belt tension.

2. The belt grinder of claim 1, further comprising a platen assembly and attachment means for detachably securing said platen assembly to said base plate.

3. The belt grinder of claim 2, wherein said platen assembly includes a tool rest, a belt platen, and at least one belt support roller, each mounted for independent adjustment and said attachment means includes means for allowing repeated removal and reattachment of said platen assembly without disturbing the adjusted positions of said tool rest, belt platen, and said at least one belt support roller.

4. The belt grinder of claim 1, further comprising inclination adjustment means for adjusting an angle of inclination of said idler wheel.

5. The belt grinder of claim 4, wherein said inclination adjustment means includes means pivotally securing said idler wheel to said tension arm.

6. The belt grinder of claim 5, wherein said idler wheel is mounted for pivotal adjustment about an axis substantially perpendicular to an axis of rotation of said idler wheel.

7. The belt grinder of claim 4, wherein said inclination adjustment means includes a pivot bar pivotally secured to said tension arm, said idler wheel mounted for rotation on said pivot bar, and means for pivotally adjusting said pivot bar with respect to said tension arm.

8. The belt grinder of claim 7, wherein said means for pivotally adjusting said pivot bar comprises screw extending through a threaded aperture in said pivot bar and having an inner end abutting said tension arm and an outer end adapted for manual rotation.

9. The belt grinder of claim 1, further comprising a slacking arm attachment for said belt grinder, said slacking arm attachment including two straight arm portions connected at an oblique angle, a belt supporting roller journalled for rotation on an end of one of said straight arm portions and the other of said straight arm portions including means for attachment to said base plate.

10. A belt grinder, comprising:

a base plate;

a plurality of grooves in said base plate disposed in spaced parallel relation to one another and including fasteners for securing one of a plurality of different attachments to said base plate in repeatable positions;

a drive motor operably connected for driving a belt drive wheel supported on said base plate;

a tension arm mounted for movement on said base plate;

an idler wheel mounted for rotation on said tension arm;

an endless loop belt mounted for rotation between said drive wheel and said idler wheel; and bias means for exerting a predetermined adjustable bias force on said tension arm to regulate belt tension.

11. The belt grinder of claim 10, wherein said plurality of different attachments includes a platen assembly including a tool rest, a belt platen, and at least one belt support roller, each mounted for independent adjustment relative to one another, said platen assembly including at least one support arm removably securable in one of said base plate grooves to provide for removal and reattachment of said platen assembly without disturbing the adjusted positions of said tool rest, belt platen, and said at least one belt support roller.

12. The belt grinder of claim 10, further comprising inclination adjustment means for adjusting an angle of inclination of said idler wheel.

13. The belt grinder of claim 12, wherein said inclination adjustment means includes means pivotally securing said idler wheel to said tension arm.

14. The belt grinder of claim 13, wherein said idler wheel is mounted for pivotal adjustment about an axis substantially perpendicular to an axis of rotation of said idler wheel.

15. The belt grinder of claim 12, wherein said inclination adjustment means includes a pivot bar pivotally secured to said tension arm, said idler wheel mounted for rotation on said pivot bar, and means for pivotally adjusting said pivot bar with respect to said tension arm.

16. The belt grinder of claim 15, wherein said means for pivotally adjusting said pivot bar comprises a screw extending through a threaded aperture in said pivot bar and having an inner end abutting said tension arm and an outer end adapted for manual rotation.

17. The belt grinder of claim 10 further comprising a slacking arm attachment for said belt grinder, said slacking arm attachment including two straight arm portions connected at an oblique angle, a belt supporting roller journalled for rotation on an end of one of said straight arm portions and the other of said straight arm portions including means for attachment to said base plate.

18. The belt grinder of claim 10, wherein said bias means comprises an air cylinder.

19. A belt grinder, comprising:

a base plate;

a plurality of horizontally extending parallel grooves in said base plate including fasteners for securing one of a plurality of different attachments to said base plate in repeatable positions;

said plurality of different attachments including a platen assembly including a tool rest, a belt platen, and at least one belt support roller, each mounted for independent adjustment relative to one another, said platen assembly including at least one support arm removably securable in one of said base plate grooves to provide for removal and reattachment of said platen assembly without disturbing the adjusted positions of said tool rest, belt platen, and said at least one belt support roller;

a drive motor operably connected for driving a belt drive wheel supported on said base plate;

a tension arm mounted by a vertically extending linear guide for reciprocal linear movement on said base plate;

an idler wheel mounted for rotation on said tension arm;

a pivot bar pivotally secured to said tension arm, said idler wheel mounted for rotation on said pivot bar, and a screw extending through a threaded aperture in said pivot bar and having an inner end abutting said tension arm and an outer end adapted for manual rotation for pivotally adjusting said pivot bar with respect to said tension arm;

an endless loop belt mounted for rotation between said drive wheel and said idler wheel; and an air cylinder for exerting a predetermined adjustable bias force on said tension arm to regulate belt tension.

20. The belt grinder of claim 19, wherein said plurality of different attachments includes a slacking arm attachment having two straight arm portions connected at an oblique angle, a belt supporting roller journalled for rotation on an end of one of said straight arm portions and the other of said straight arm portions dimensioned for removable receipt in one of said base plate grooves for releasably securing said slacking arm attachment to said base plate.

* * * * *